US011397013B2

(12) United States Patent
Abe et al.

(10) Patent No.: US 11,397,013 B2
(45) Date of Patent: Jul. 26, 2022

(54) AIR-SENDING DEVICE AND AIR-CONDITIONING APPARATUS

(71) Applicant: Mitsubishi Electric Corporation, Tokyo (JP)

(72) Inventors: Takafumi Abe, Tokyo (JP); Takahide Tadokoro, Tokyo (JP); Katsuyuki Yamamoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/043,313

(22) PCT Filed: May 22, 2018

(86) PCT No.: PCT/JP2018/019683
§ 371 (c)(1),
(2) Date: Sep. 29, 2020

(87) PCT Pub. No.: WO2019/224918
PCT Pub. Date: Nov. 28, 2019

(65) Prior Publication Data
US 2021/0033292 A1 Feb. 4, 2021

(51) Int. Cl.
*F24F 1/56* (2011.01)
*F24F 1/40* (2011.01)
*F04D 29/70* (2006.01)

(52) U.S. Cl.
CPC ..... *F24F 1/56* (2013.01); *F24F 1/40* (2013.01); *F04D 29/703* (2013.01)

(58) Field of Classification Search
CPC .. F24F 1/56; F24F 1/40; F04D 29/703; F04D 13/082; F04D 29/663; F04D 19/002; F04D 25/08
See application file for complete search history.

(56) References Cited

U.S. PATENT DOCUMENTS 6,196,803 B1 * 3/2001 Hill ..... F04D 29/601 415/121.2
6,364,618 B1 * 4/2002 Moreno ..... F04D 29/703 403/13

(Continued)

FOREIGN PATENT DOCUMENTS

JP H05-215367 A 8/1993
JP 2000-346403 A 12/2000

(Continued)

OTHER PUBLICATIONS

International Search Report of the International Searching Authority dated Aug. 7, 2018 for the corresponding International application No. PCT/JP2018/019683 (and English translation).

(Continued)

*Primary Examiner* — Aaron R Eastman
(74) *Attorney, Agent, or Firm* — Posz Law Group, PLC

(57) ABSTRACT

An air-sending device includes a fan and a grille provided downstream of the fan in a direction of airflow generated by the fan. The grille includes a first grille that includes a plurality of first bars spaced from each other, and a second grille that includes a plurality of second bars spaced from each other. The plurality of second bars are more densely arranged than the plurality of first bars. The second grille is provided upstream of the first grille in the direction of the airflow generated by the fan, and spaced from the first grille to face the first grille.

6 Claims, 7 Drawing Sheets

(56) References Cited

U.S. PATENT DOCUMENTS

| | | | | |
|---|---|---|---|---|
| 6,585,489 | B2 * | 7/2003 | Perella | F04D 29/703 416/247 R |
| 2010/0319901 | A1 * | 12/2010 | Agarwal | F24F 5/0017 165/253 |
| 2011/0293959 | A1 * | 12/2011 | Heng | B21D 11/14 428/592 |

FOREIGN PATENT DOCUMENTS

| | | | |
|---|---|---|---|
| JP | 2002-188834 | A | 7/2002 |
| JP | 2003-035438 | A | 2/2003 |
| JP | 2008-096037 | A | 4/2008 |
| JP | 2009-014234 | A | 1/2009 |
| WO | 2004/ 094918 | A1 | 11/2004 |
| WO | 2017/042865 | A1 | 3/2017 |

OTHER PUBLICATIONS

Office Action dated Jun. 28, 2021, issued in corresponding CN Patent Application No. 201880093549.6 (and English Machine Translation).

Extended European Search Report dated Apr. 28, 2021 issued in corresponding European patent application No. 18920131.2.

Office Action dated Sep. 21, 2021 issued in corresponding JP Patent Application No. 2020-520908 (and English Machine Translation).

Office Action dated Feb. 7, 2022 issued in corresponding CN patent application No. 201880093549.6 (and English translation).

* cited by examiner

AIR-SENDING DEVICE AND AIR-CONDITIONING APPARATUS

CROSS REFERENCE TO RELATED APPLICATION

This application is a U.S. national stage application of PCT/JP2018/019683 filed on May 22, 2018, the contents of which are incorporated herein by reference.

TECHNICAL FIELD

The present disclosure relates to an air-sending device that can further reduce noise and an air-conditioning apparatus including an air-sending device.

BACKGROUND ART

As an existing air-sending device, an air-sending device including a fan and a grille provided downstream of the fan in the direction of airflow generated by the fan is known. The grille is made up of bars spaced from each other. Such an air-sending device is employed in, for example, an air-conditioning apparatus. To be more specific, the fan is provided in the housing of the air-conditioning apparatus, and the grille is attached to, for example, an air outlet of the housing. In such a manner, since the air-sending device is provided in the housing of the air-conditioning apparatus, it is possible to prevent, for example, a finger from accidentally entering the housing through the air outlet and touching the fan.

Since the grille is provided downstream of the fan, airflow blown from the fan strikes the bars of the grille. The airflow that has struck the bars initially flows along surfaces of the bars, but then flows away from the surfaces along the way. Consequently, vortices generate on the downstream side of the bars, and cause noise. Thus, among the grilles of existing air-sending devices, grilles formed to reduce noise have been proposed (see Patent Literature 1). More specifically, an air-sending device disclosed in Patent Literature 1 includes a grille that is formed to include bars in the same manner as in an existing grille, and provided upstream of the existing grille in the direction of airflow generated by a fan. It should be noted that the grille on the upstream side will be referred to as an upstream-side grille and the grille located downstream of the upstream-side grille will be referred to as a downstream-side grille. The bars of the upstream-side grille are thinner than those of the downstream-side grille. In the above air-sending device disclosed in Patent Literature 1, airflow that has been spread by the thin bars of the upstream-side grille strikes the bars of the downstream-side grille. According to Patent Literature 1, since the spread airflow strikes the bars of the downstream-side grille, it is possible to reduce the amount of the airflow that flows away from the surfaces of the bars of the downstream-side grille; and thus reduce the number of vortices generated on the downstream side of the bars of the downstream-side grille, and reduce noise.

CITATION LIST

Patent Literature

Patent Literature 1: Japanese Unexamined Patent Application Publication No. 2000-346403

SUMMARY OF INVENTION

Technical Problem

The air-sending device disclosed in Patent Literature 1 can reduce the amount of airflow that flows away from the surfaces of the bars of the downstream-side grille and thus reduce noise, as compared with an air-sending device having no upstream-side grille. However, the noise reduction in the air-sending device disclosed in Patent Literature 1 is not sufficient. It has therefore been required to further reduce noise.

The present disclosure is applied to solve the above problem. The present disclosure relates to an air-sending device that can further reduce noise made by a grille, as compared with an existing air-sending device, and an air-conditioning apparatus including the air-sending device.

Solution to Problem

An air-sending device according to one embodiment of the present disclosure includes a fan and a grille provided downstream of the fan in a direction of airflow generated by the fan. The grille includes a first grille that includes a plurality of first bars spaced from each other, and a second grille that includes a plurality of second bars spaced from each other. The plurality of second bars are more densely arranged than the plurality of first bars. The second grille is provided upstream of the first grille in the direction of the airflow generated by the fan, and spaced from the first grille to face the first grille.

An air-conditioning apparatus according to another embodiment of the present disclosure includes the air-sending device according to the embodiment of the present disclosure, and a heat exchanger through which airflow generated by the fan of the air-sending device passes.

Advantageous Effects of Invention

In the air-sending device according to the embodiment of the present disclosure, when passing through the second grille, airflow generated by the fan is split into slightly disturbed fine airflows. Then, in the air-sending device according to the embodiment of the present disclosure, the slightly disturbed fine airflows strike the first bars of the first grille and flow along the surfaces of the first bars. It should be noted that in the case where the slightly disturbed airflows flow along the surfaces of the first bars, it is possible to further reduce the amount of airflows that flow away from the surfaces of the first bars, as compared with the case where laminar airflow flows along the surfaces of the first bars Thus, in the air-sending device according to the embodiment of the present disclosure, the number of vortices generated on the downstream side of the first bars can be reduced, and noise can be reduced, as compared with the existing air-sending device.

DESCRIPTION OF EMBODIMENTS

An example of an air-sending device according to an embodiment of the present disclosure and an example of an air-conditioning apparatus provided with the air-sending device will be described. The following description is made by referring to by way of example the case where the example of the air-sending device according to the embodiment of the present disclosure is provided in an outdoor unit of the air-conditioning apparatus.

Embodiment

Figure 1:
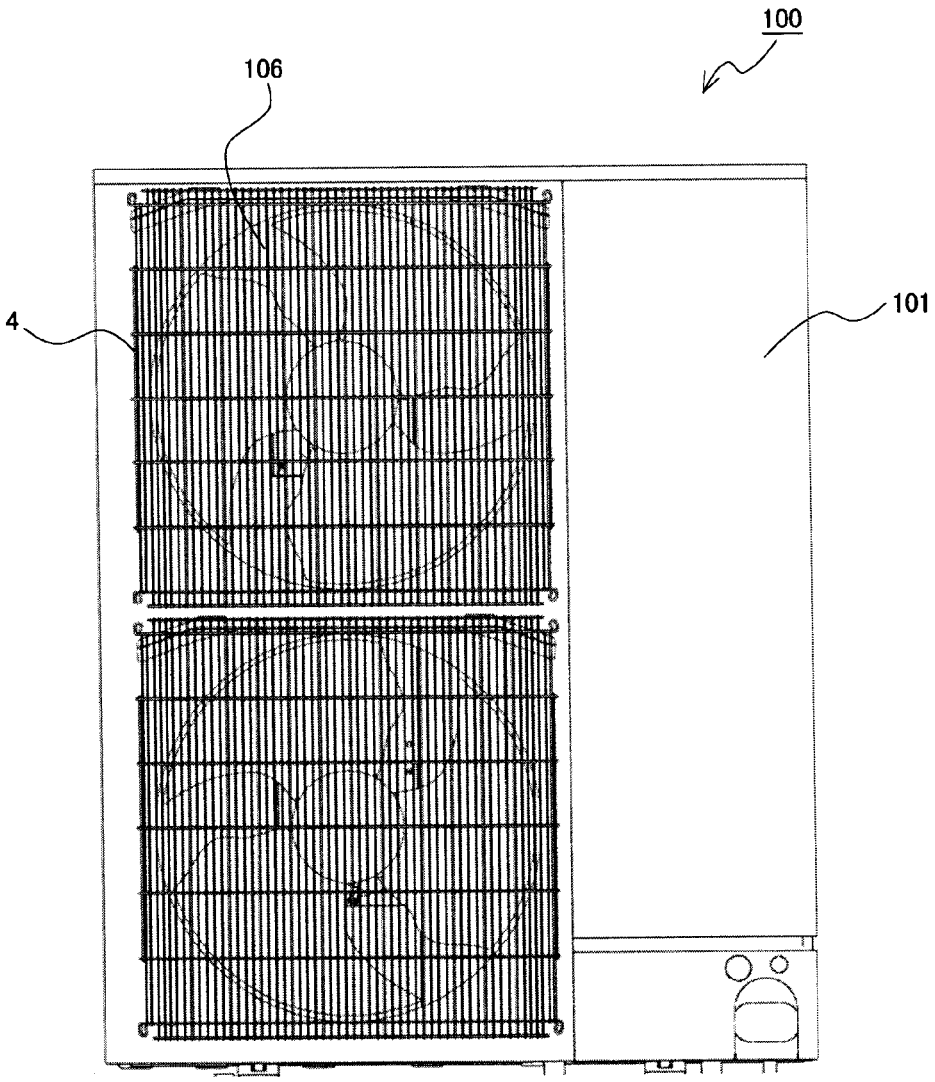
FIG. 1 is a front view of an outdoor unit of an air-conditioning apparatus according to an embodiment of the present disclosure.
Figure 2:
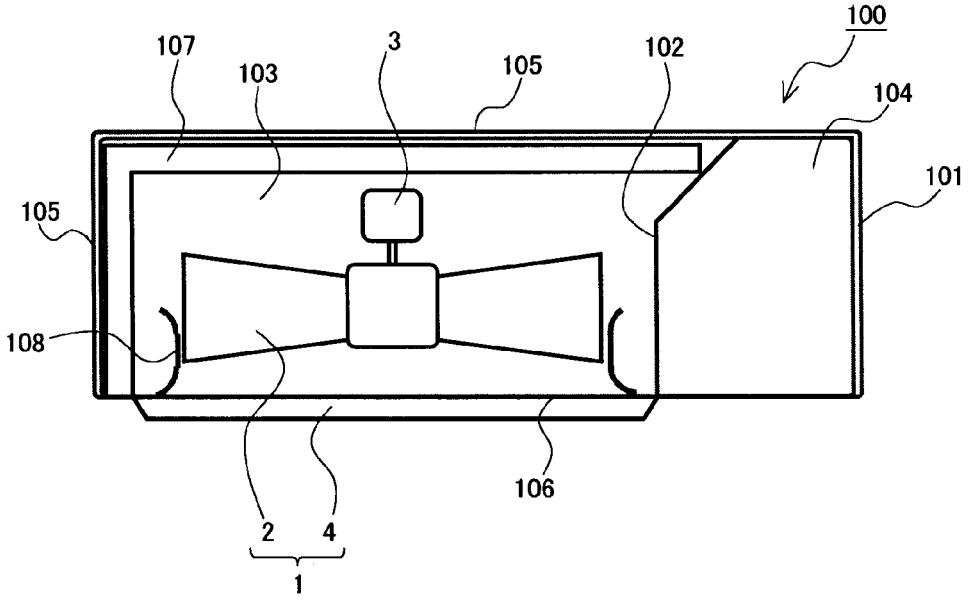
FIG. 2 is a plan view of the interior of the outdoor unit of the air-conditioning conditioning apparatus according to the embodiment of the present disclosure.

FIG. 1 is a front view of an outdoor unit of an air-conditioning apparatus according to an embodiment of the present disclosure. FIG. 2 is a plan view of the interior of the outdoor unit of the air-conditioning apparatus according to the embodiment of the present disclosure. It should be noted that FIG. 2 illustrates the interior of an outdoor unit 100, with the top of a housing 101 of the outdoor unit 100 detached from the housing 101. Also, in FIG. 2, regarding a bell mouth 108, only a cross section of the bell mouth 108 is indicated in order that a propeller fan 2 of an air-sending device 1 be clearly illustrated. In addition, a lower side of FIG. 2 corresponds to a front side of the outdoor unit 100.

The outdoor unit 100 of the air-conditioning apparatus includes the housing 101, which is formed in the shape of, for example, substantially a cuboid. The interior of the housing 101 is divided by a partition plate 102 into an air-sending device chamber 103 and a machine chamber 104. The air-sending device chamber 103 of the housing 101 has air inlets 105 and an air outlet 106. In the embodiment, in a side portion and a back portion of the housing 101, the air inlets 105 are provided, and in the front portion of the housing 101, the air outlet 106 is provided.

In the air-sending device chamber 103, a heat exchanger 107, which is, for example, a fin-tube heat exchanger, is provided to face the air inlet 105. As discussed above, in the embodiment, in the side portion and the back portion of the housing 101, the air inlets 105 are provided. Thus, the heat exchanger 107 is substantially L-shaped as viewed in plan view. It should be noted that the machine chamber 104 houses, for example, a compressor not illustrated, which forms together with the heat exchanger a refrigerant circuit.

In addition, the outdoor unit 100 includes the air-sending device 1. The air-sending device 1 includes the propeller fan 2 and a grille 4 that is provided downstream of the propeller fan 2 in the direction of airflow generated by the propeller fan 2. The air-sending device chamber 103 houses the propeller fan 2. To the propeller fan 2, a fan motor 3 is attached. The fan motor 3 is provided to rotate the propeller fan 2. The air-sending device chamber 103 has the bell mouth 108 that covers an outer peripheral portion of the propeller fan 2, with a space provided between the bell mouth 108 and the propeller fan 2. The bell mouth 108 is provided to guide airflow from the propeller fan 2 to the air outlet 106. The grille 4 is provided to cover the air outlet 106 and prevent, for example, a finger from accidentally entering the housing 101 through the air outlet 106 and touching the propeller fan 2. It should be noted that the grille 4 will be described later in detail.

In the outdoor unit 100 having the above configuration, when the propeller fan 2 is rotated, airflow, that is, the flow of air, is generated. More specifically, when the propeller fan 2 is rotated, air close to the housing 101 is sucked into the air-sending device chamber 103 through the air inlet 105. The air sucked into the air-sending device chamber 103 passes through the heat exchanger 107, while exchanging heat with refrigerant that flows in the heat exchanger 107. Then, the propeller fan 2 sucks the air that has passed through the heat exchanger 107, and then blows out the air. The air blown from the propeller fan 2 is guided to the air outlet 106 by the bell mouth 108 and discharged to the outside of the housing 101 through the air outlet 106 and the grille 4.

In an outdoor unit of an existing air-conditioning apparatus, a laminar airflow from a fan strikes bars of a grille. The airflow that has struck the bars initially flows along surfaces of the bars but then flows away from the surfaces on the way. Thus, in the outdoor unit of the existing air-conditioning apparatus, vortices are generated on a downstream side of the bars, thus causing noise. In view of this point, in the air-sending device 1 according to the embodiment, the grille 4 is configured as described below to reduce noise made at the grille 4.

Figure 3:
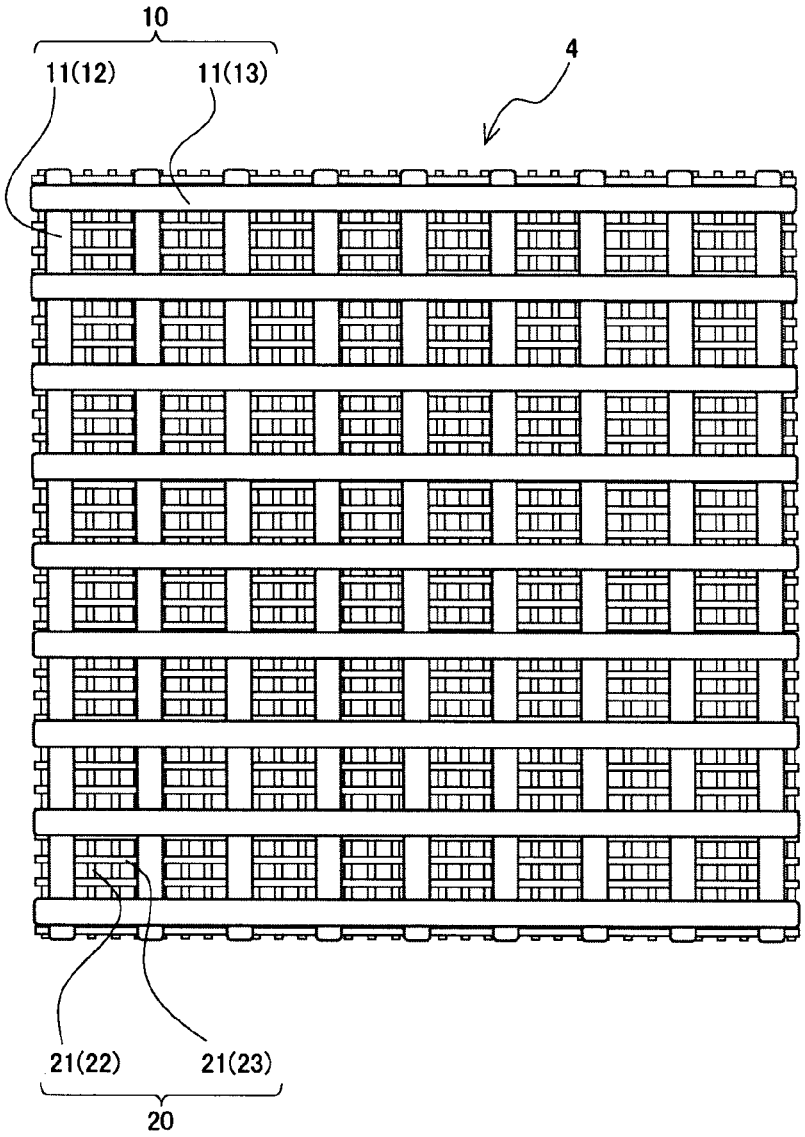
FIG. 3 is a front view of a grille of an air-sending device according to the embodiment of the present disclosure.
Figure 4:
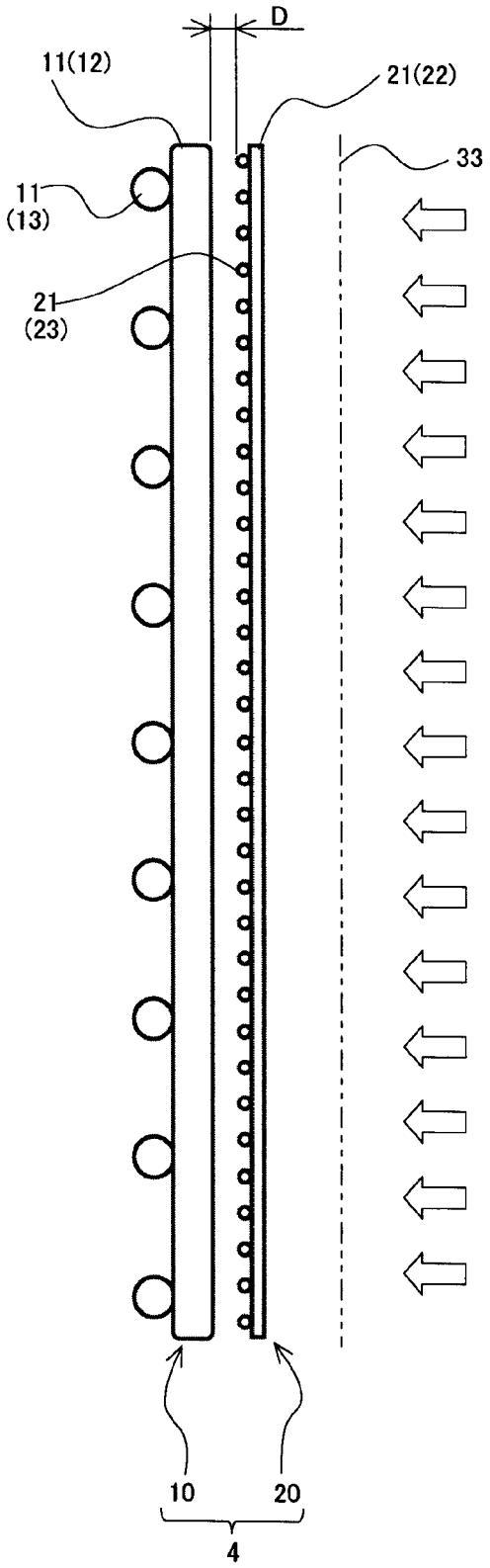
FIG. 4 is a side view of part of the grille of the air-sending device according to the embodiment of the present disclosure.

FIG. 3 is a front view of the grille of the air-sending device according to the embodiment of the present disclosure. Referring to FIG. 3, the airflow generated by the propeller fan 2 passes through the grille 4, that is, the generated airflow flows in a direction from a region located under the plane of the figure toward a region located above the plane. FIG. 4 is a side view of part of the grille of the air-sending device according to the embodiment of the present disclosure. In FIG. 3, the region located in front of the grille 4 corresponds to left part of FIG. 4. Referring to FIG. 4, as illustrated by outlined arrows, the airflow generated by the propeller fan 2 passes through the grille 4, that is, the generated airflow flows from the right side of FIG. 4 to the left side thereof.

The grille 4 according to the embodiment has a first grille 10 and a second grille 20. The first grille 10 includes first bars 11 that are spaced apart from each other. It should be noted that in the embodiment, the first bars 11 are arranged in a lattice manner. To be more specific, as the first bars 11, the first grille 10 has vertical bars 12 that are spaced apart from each other in a lateral direction of the first grille 10 and horizontal bars 13 that are spaced from each other in an up/down direction. Because of the arrangement of the vertical bars 12 and the horizontal bars 13, the first grille 10 is formed into a lattice shape.

The second grille 20 is made up of second bars 21 spaced from each other. It should be noted that in the embodiment, the second bars 21 are thinner than the first bars 11. Furthermore, in the embodiment, the second bars 21 are arranged in a lattice pattern. To be more specific, in the second grille 20, as the second bars 21, vertical bars 22 and horizontal bars 23 are provided; and the vertical bars 22 are spaced from each other in the lateral direction, and the horizontal bars 23 are spaced from each other in the up/down direction. Because of the arrangement of the vertical bars 22 and the horizontal bars 23, the second grille 20 is formed in a lattice manner.

The second bars 21 of the second grille 20 are more densely provided than the first bars 11 of the first grille 10. That is, a space surrounded by any four adjacent second bars 21 of the second grille 20 is smaller than a space surrounded by any four adjacent first bars 11 of the first grille 10. Moreover, the second grille 20 is provided upstream of the first grille 10 in the direction of the airflow generated by the propeller fan 2 and spaced from the first grille 10 by a distance D in such a manner as to face the first grille 10.

In the grille 4 having the above configuration, the airflow generated by the propeller fan 2 passes through the grille 4 in the following manner. As described above, the second bars 21 of the second grille 20 are more densely arranged than the first bars 11 of the first grille 10. Thus, when passing through the second grille 20, the airflow generated by the propeller fan 2 is split into slightly disturbed fine airflows. Then, the slightly disturbed fine airflows strike the first bars 11 of the first grille 10 and flow along the surfaces of the first bars 11

It should be noted that in the case where airflows flow along a surface of the same object, a slightly disturbed fine airflow does not easily fly away from the surface of the object, as compared with laminar airflow, and continuously flows along the surface of the object to a further downstream position than the laminar airflow. A technique based on this phenomenon is also applied to, for example, golf balls. To be more specific, in a surface of a golf ball, small indentations referred to as dimples are formed. Because of the dimples, airflow that flows along the surface of the golf ball is slightly disturbed. Thus, the golf ball reduces the degree to which the airflow flowing along the surface of the golf ball flies away from the surface.

In the grille 4 according to the embodiment, slightly disturbed airflows are generated at the second grille and then supplied to the surfaces of the first bars 11 of the first grille 10. Thus, the slightly disturbed airflows can flow along the surfaces of the first bars 11 to a further downstream position without flowing away from the surfaces of the first bars 11 than in the case where laminar airflow flows along the surfaces of the first bars 11. Thus, in the grille 4 according to the embodiment, it is possible to reduce the number of vortices that generate on a downstream side of the first bars 11 and also reduce noise that is made at the grille 4, as compared with an existing grille.

It should be noted that the grille 4 described above is a mere example. For example, as a grille of the air-sending device, a grille made up of radially extending linear bars and concentrically arranged circular bars is known. The first grille 10 and the second grille 20 of the grille 4 according to the embodiment may have such a configuration. In this case, as long as the second bars 21 of the second grille 20 are more densely arranged than the first bars 11 of the first grille 10, it is possible to reduce noise that is made at the grille 4 as described above.

In the second grille 20 of the grille 4 described above, all the spaces each surrounded by associated four adjacent second bars 21 have the same size. This, however, is not limiting, and as illustrated in FIG. 5, the spaces each surrounded by the associated four adjacent second bars 21 may have different sizes such that the size of each space depends on the velocity of the airflow that passes through the space.

Figure 5:
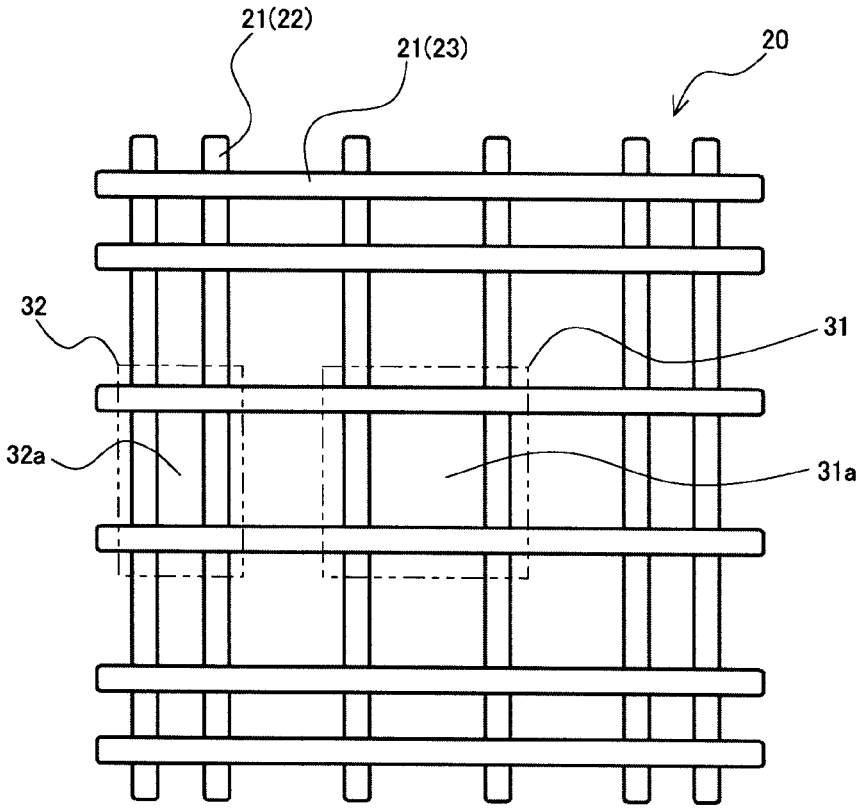
FIG. 5 is a front view of another example of a second grille according to the embodiment of the present disclosure.

FIG. 5 is a front view of another example of the second grille according to the embodiment of the present disclosure.

The smaller the space surrounded by any four adjacent second bars 21, the smaller airflows into which airflow is split when passing through the second grille 20, and the greater the degree to which the noise at the grille 4 is reduced. In other words, in the case where the second bars 21 are more densely arranged, it is possible to split the airflow that passes through the second grille 20 into finer airflows. As a result, it is possible to further reduce noise that is made at the second grille 20. On the other hand, the higher the density at which the second bars 21 are arranged, the higher the resistance of the second grille 20 against the airflow. In addition, the stronger the vortices generated on the downstream side of the first bars 11, the bigger the noise that is made at the grille 4. Also, the higher the velocity of the airflow that strikes the first bars 11, the stronger the vortices that are generated on the downstream side of the first bars 11.

Thus, in the second grille 20 as illustrated in FIG. 5, the second bars 21 are arranged such that the higher the velocity of airflow that passes through an area, the higher the density at which second bars 21 are arranged in the area. For example, it is assumed that an arbitrary area in the second grille 20 as illustrated in FIG. 5 is a first area 31, and an area through which airflow passes at a velocity higher than the velocity of airflow that passes through the first area 31 is a second area 32. In this case, in the second area 32, second bars 21 are more densely arranged than second bars 21 arranged in the first area 31. That is, a space 32*a* surrounded by four adjacent second bars 21 in the second area 32 is smaller than a space 31*a* surrounded by four adjacent second bars 21 in the first area 31. Because of the above configuration of the second grille 20, in an area in which airflow flows at a high velocity and thus big noise would be made, the airflow is split into fine airflows to reduce nose, and in an area which airflow flows at a low velocity and thus big noise would not be made, an airflow resistance against the airflow is small. Therefore, in the second grille 20 having the above configuration, it is possible to reduce the airflow resistance while reducing noise.

Figure 6:
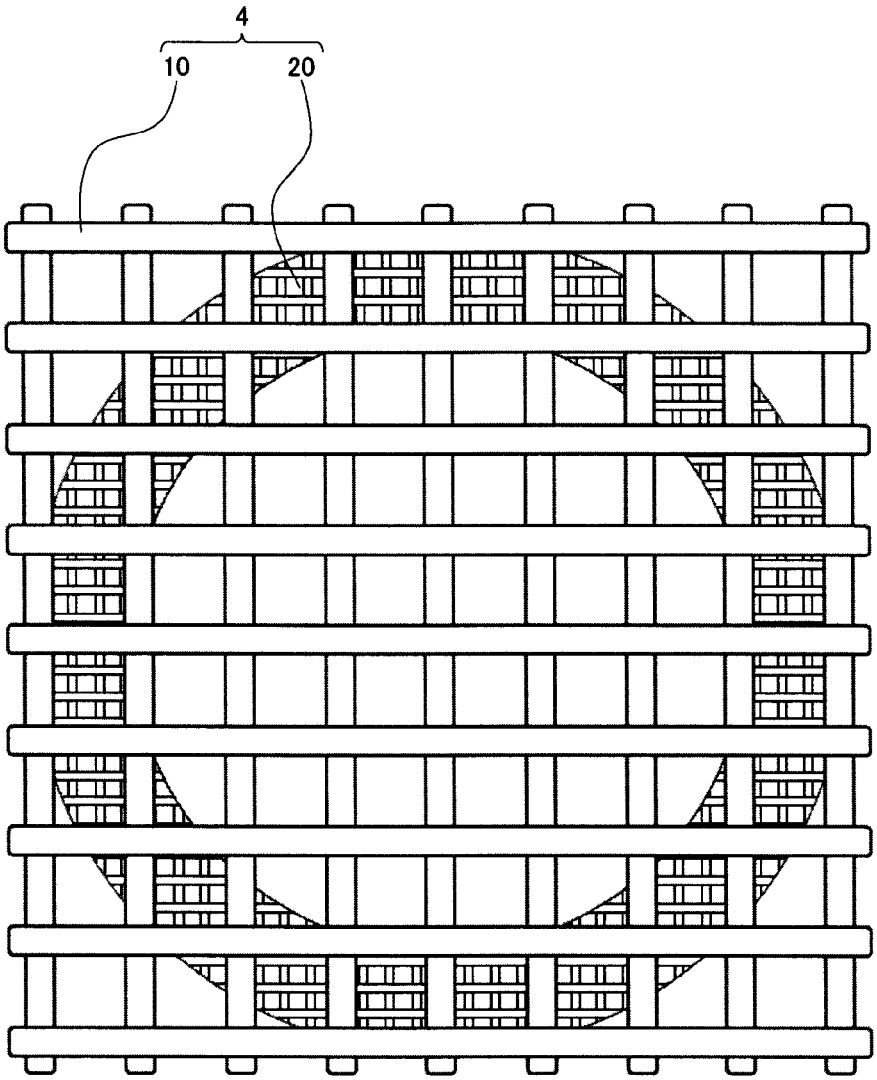
FIG. 6 is a front view of another example of the grille according to the embodiment of the present disclosure.

Furthermore, for example, also in the case where the second grille 20 is configured as illustrated in FIG. 6, it is possible to reduce the airflow resistance while reducing noise.

FIG. 6 is a front view of another example of the grille according to the embodiment of the present disclosure.

The second grille 20 as illustrated in FIG. 6 is provided only in an area through which airflow passes at a velocity higher than a predetermined velocity. That is, the second grille 20 as illustrated in FIG. 6 is provided only in an area through which airflow passes at a high velocity, as a result of which big noise would be made. It should be noted that the velocity of airflow near distal end portions of blades of the propeller fan 2 is high. Thus, the second grille 20 as illustrated in FIG. 6 is provided to face the distal end portions of the blades of the propeller fan 2. Also, in the case where the second grille 20 is configured in the above manner, it is possible to reduce the airflow resistance while reducing noise.

In addition, the second grille 20 of the grille 4 as described above is formed in the shape of a plate. To be more specific, it is assumed that as illustrated in FIG. 4, a reference plane 33 is an imaginary plane that is located perpendicular to the direction of the airflow generated by the propeller fan 2 and located parallel to the second grille 20 and upstream of the second grille 20 in the direction of the airflow. The distance from the reference plane 33 to the second grille 20 is substantially constant from one of ends of the second grille 20 to the other. However, this is just an example, and as illustrated in FIG. 7, the distance from the reference plane 33 to the second grille 20 may be set to vary from one part of the second grille 20 to another part thereof based on the velocity of airflow that passes through part of the second grille 20.

Figure 7:
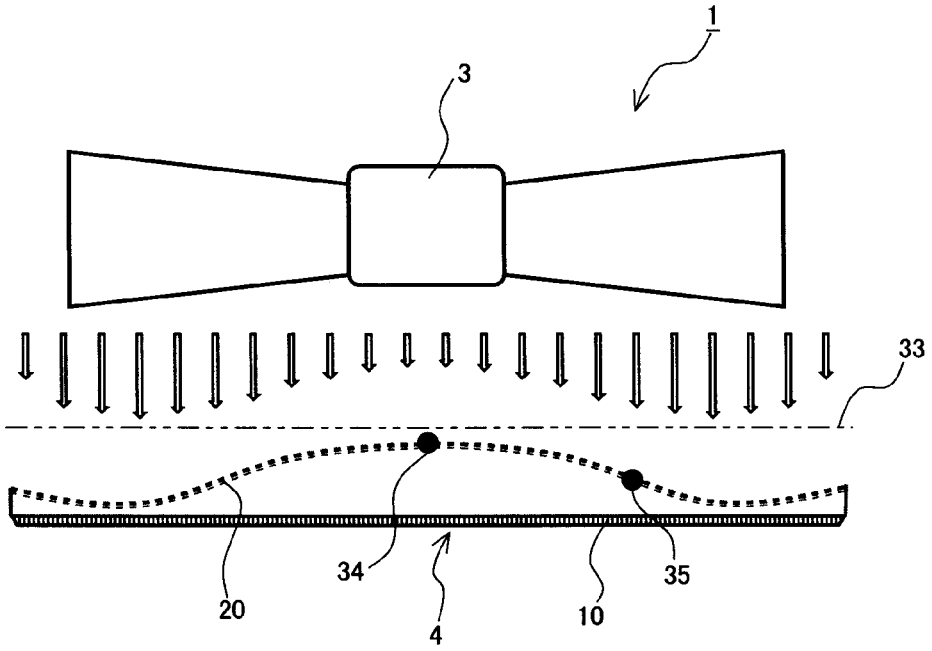
FIG. 7 is a plan view of another example of the air-sending device according to the embodiment of the present disclosure.

FIG. 7 is a plan view of another example of the air-sending device according to the embodiment of the present disclosure. It should be noted that in FIG. 7, outlined arrows indicate airflow generated by the propeller fan 2. In FIG. 7, the longer the outlined arrow, the higher the velocity of the airflow.

As described above, the airflow close to the distal end portions of the blades of the propeller fan 2 flows at a higher velocity. Furthermore, the higher the velocity of the airflow, the bigger the noise caused when the airflow strikes an object. Thus, the second grille 20 as illustrated in FIG. 7 is configured such that the higher the velocity of the airflow passes through part of the second grille 20, the more downstream the part is located in in the direction of the airflow. The velocity of the airflow decreases as the airflow further flows in a downstream direction. Thus, because of the above configuration of the second grille 20, it is possible to reduce noise that is made when the airflow strikes the second grille 20.

More specifically, at the second grille 20 as illustrated in FIG. 7, the higher the velocity of airflow that passes through part of the second grille 20, the greater the distance between the part and the reference plane 33 that is located upstream of the second grille 20. For example, it is assumed that an arbitrary location at the second grille 20 is a first location 34, and a location at the second grille 20 through which airflow passes at a velocity higher than the velocity of the airflow that passes through the first location 34 is a second location 35. In this case, part of the second bars 21 that is located at the second location 35 is farther from the reference plane 33 than part of the second bars 21 that is located at the first location 34.

It should be noted that in an existing air-sending device that includes only one grille located downstream of a fan, also in the case the grille is configured in a similar manner to that of the second grille 20 as illustrated in FIG. 7, it is possible to reduce noise. However, in the case where such an air-sending device is used in an outdoor unit of an air-conditioning apparatus, the grille forms part of an outer shell of the outdoor unit. Thus, the grille directly influences the appearance and safety of the outdoor unit. Thus, actually, in the existing air-sending device including only one grille located downstream of the fan, the grille cannot be formed into a specific shape and thus cannot be configured in a similar manner to that of the second grille 20 as illustrated in FIG. 7. By contrast, in the air-sending device 1 according to the embodiment, the first grille 10 of the grille 4 forms part of an outer shell of the outdoor unit 100. Thus, in the air-sending device 1 according to the embodiment, the second grille can be configured as illustrated in FIG. 7, and reduce noise.

In addition, in the embodiment, the second bars 21 of the second grille 20 are thinner than the first bars 11 of the first grille 10. However, the thickness of each of the second bars 21 is not limited to such a thickness. For example, the second bars 21 may be formed to have the same thickness as the first bars 11. However, the second bars 21 are more densely arranged than the first bars 11. Thus, in order to reduce the airflow resistance of the second grille 20, it is preferable that the second bars 21 be thinner than the first bars 11 of the first grille 10.

Furthermore, although the air-sending device 1 according to the embodiment includes the propeller fan 2, the air-sending device 1 may include a fan other than the propeller fan 2. Since the grille 4 has the above configuration, it is possible to reduce noise at the grille 4. In this case, the configuration of the second grille 20 may be modified as illustrated in FIGS. 5 to 7.

For example, it is assumed that the air-sending device 1 includes a sirocco fan that is housed in a scroll casing. In this case, the velocity of airflow that is blown through an air outlet of the casing increases as the distance between the airflow blown and an outer peripheral portion of the air outlet decreases. Thus, in the air-sending device 1 including the sirocco fan housed in the scroll casing, in the case where the configuration of the second grille 20 is modified as illustrated in FIG. 5, it suffices that second bars 21 located in an area that faces the outer periphery portion of the air outlet of the casing are more densely arranged than second bars 21 located in an area parallel to an inner periphery portion of the air outlet of the casing. Furthermore, in the air-sending device 1 including the sirocco fan housed in the scroll casing, in the case where the configuration of the second grille 20 is modified as illustrated in FIG. 6, for example, it suffices that the second grille 20 is provided only at an area parallel to the outer periphery portion of the air outlet of the casing. In addition, in the air-sending device 1 including the sirocco fan housed in the scroll casing, in the case where the configuration of the second grille 20 is modified as illustrated in FIG. 7, it suffices that the second grille 20 is configured such that the closer part of the second grille 20 to the outer periphery portion of the air outlet of the casing, the greater the distance between the part of the second grille 20 and the reference plane 33.

A unit in which the air-sending device 1 is provided is not limited to the outdoor unit 100 of the air-conditioning apparatus. For example, the air-sending device 1 may be provided in the indoor unit of the air-conditioning apparatus. Alternatively, the air-sending device 1 may be provided in an apparatus other than the air-conditioning apparatus.

Thus, the air-sending device 1 according to the embodiment includes the fan and the grille 4 that is located downstream of the fan in the direction of the airflow generated by the fan. The grille 4 includes the first grille 10 and the second grille 20. The first grille 10 is made up of the first bars 11 that are spaced from each other. The second grille 20 is made up of the second bars 21 that are spaced from each other. The second bars 21 are more densely arranged than the first bars 11. The second grille 20 is provided to face the first grille 10 and located upstream of the first grille 10 in the direction of the airflow generated by the fan.

Therefore, in the air-sending device 1 according to the embodiment, when passing through the second grille 20, the airflow generated by the fan is split into slightly disturbed fine airflows. Then, the slightly disturbed fine airflows strike the first bars 11 of the first grille 10 and flow along the surfaces of the first bars 11. It should be noted that when the slightly disturbed airflows flow along the surfaces of the first bars 11, it is possible to more reduce the degree to which the slightly distributed airflows flow away from the surfaces of the first bars 11 than the degree to which laminar airflow flows away from the surfaces of the first bars 11, when flowing along the surfaces of the first bars 11. Therefore, in the air-sending device 1 according to the embodiment, it is possible to more reduce the number of vortices that generate on the downstream side of the first bars 11 than in the existing air-sending device, and thus further reduce noise than the existing air-sending device.

REFERENCE SIGNS LIST

1 air-sending device 2 propeller fan 3 fan motor 4 grille 10 first grille 11 first bar 12 vertical bar 13 horizontal bar 20 second grille 21 second bar 22 vertical bar 23 horizontal bar 31 first area 31*a* space 32 second area 32*a* space 33 reference plane 34 first location 35 second location 100 outdoor unit 101 housing 102 partition plate 103 air-sending device chamber 104 machine chamber 105 air inlet 106 air outlet 107 heat exchanger 108 bell mouth D distance

The invention claimed is:

1. An air-sending device comprising:

a fan; and a grille provided downstream of the fan in a direction of airflow generated by the fan, wherein the grille includes a first grille that includes a plurality of first bars spaced from each other, and a second grille that includes a plurality of second bars spaced from each other, the plurality of second bars are more densely arranged than the plurality of first bars, the second grille is provided upstream of the first grille in the direction of the airflow generated by the fan, and spaced from the first grille to face the first grille, the plurality of first bars include a plurality of first vertical bars, and a plurality of first horizontal bars, the plurality of second bars include a plurality of second vertical bars, and a plurality of second horizontal bars, the plurality of first vertical bars and first horizontal bars are arranged in first lattice pattern, and the plurality of second vertical bars and second horizontal bars are arranged in second lattice pattern.

2. The air-sending device of claim 1, wherein where a first area is an arbitrary area of the second grille, and a second area is an area of the second grille through which airflow flows at a higher velocity than airflow that passes through the first area, of the plurality of second bars, second bars located in the second area are more densely arranged than second bars located in the first area.

3. The air-sending device of claim 1, wherein the second grille is provided only at an area through which the airflow passes at a velocity higher than a predetermined velocity.

4. The air-sending device of claim 1, wherein where a reference plane is an imaginary plane that is located perpendicular to the direction of the airflow generated by the fan and located to face the second grille and upstream of the second grille in the direction of the airflow, a first location is an arbitrary location at the second grille, and a second location is a location at the second grille through which airflow passes at a higher velocity than airflow that passes through the first location, part of the second bars that is located at the second location is farther from the reference plane than part of the second bars that is located at the first location.

5. The air-sending device of claim 1, wherein the plurality of second bars are thinner than the plurality of first bars.

6. An air-conditioning apparatus comprising:

the air-sending device of claim 1; and a heat exchanger through which airflow generated by the fan of the air-sending device passes.

* * * * *